United States Patent [19]

Stamp et al.

[11] 4,220,145

[45] Sep. 2, 1980

[54] HYDROTHERAPY APPARATUS

[76] Inventors: Roger A. Stamp, 4323 NE. 20th, Portland, Oreg. 97211; Farrell D. Williams, 21545 SE. Oak, Troutdale, Oreg. 97060

[21] Appl. No.: 58,114

[22] Filed: Jul. 16, 1979

[51] Int. Cl.[2] ..... A61H 9/00

[52] U.S. Cl. ..... 128/66

[58] Field of Search ..... 128/65, 66, 368, 256; 4/145, 165, 180

[56] References Cited

U.S. PATENT DOCUMENTS

| | | | |
|---|---|---|---|
| 1,038,656 | 9/1912 | Reuter | 128/66 |
| 1,948,167 | 2/1934 | Cornwell | 128/66 |
| 2,304,616 | 12/1942 | Watson | 128/66 |
| 3,038,469 | 6/1962 | Jacuzzi | 128/66 |
| 3,067,739 | 12/1962 | Karlik | 128/66 |
| 3,092,101 | 6/1963 | Kinney | 128/66 |
| 3,287,741 | 11/1966 | Nash | 128/66 |
| 3,396,722 | 8/1968 | Lindberg | 128/66 |
| 3,534,730 | 10/1970 | Jacuzzi | 128/66 |
| 3,587,976 | 6/1971 | Jacuzzi | 239/428.5 |
| 3,693,615 | 9/1972 | Danoyer | 128/66 |
| 3,766,911 | 10/1973 | Green | 128/66 |
| 3,868,949 | 3/1975 | Arneson | 128/66 |

*Primary Examiner*—Lawrence W. Trapp

*Attorney, Agent, or Firm*—Klarquist, Sparkman, Campbell, Leigh, Hall & Whinston

[57] ABSTRACT

A hydrotherapy apparatus having a single nozzle which is continuously rotated through a circular path by a water wheel. Conduits divide a source of pressurized water into first and second portions, the first portion flowing past the water wheel before rejoining the second portion. Thereafter both portions flow through a venturi where they are aerated, through the center of the rotating flywheel, and through the rotating nozzle from which they are discharged. A valve can be manually adjusted for varying the amount of pressurized water that flows past the water wheel to alter its speed of rotation.

11 Claims, 4 Drawing Figures

HYDROTHERAPY APPARATUS

BACKGROUND OF THE INVENTION

The present invention relates to hydrotherapy apparatuses, and more particularly to such an apparatus having a signal nozzle which is continuously rotated through a circular path by a water wheel driven by a source of pressurized water which is discharged through the nozzle after flowing past the water wheel.

The therapeutic and relaxation benefits of hydrotherapy have long been recognized. The whirlpool bath has been used extensively in the treatment of discomfort resulting from strained muscles, joint ailments, peripheral vascular diseases, crippling illnesses, and the like. Hydrotherapy often relieves pain and in many cases it accelerates the healing process by improving local blood circulation. More recently, hydrotherapy has come into extensive use as a form of relaxation and recreation to counter the stresses of modern life.

A wide variety of hydrotherapy aparatuses have heretofore been patented. U.S. Pat. No. 3,092,101 discloses an inflatable therapy pool having submerged nozzles at each of its four corners for discharging air from blowers to create swirls of bubbles in the middle of the pool. U.S. Pat. Nos. 3,038,469; 3,287,741; and 3,534,730 cover hydrotherapy apparatus designs owned by the manufacture of JACUZZI (trademark) brand devices. Each includes a signal nozzle whose angle of discharge can be manually adjusted. U.S. Pat. Nos. 3,396,722 and 3,587,976 each disclose a hydrotherapy apparatus having a venturi for aerating a stream of water before it is discharged therefrom.

U.S. Pat. Nos. 3,693,615; 3,766,911; and 3,868,949 each disclose a hydrotherapy device having nozzles which are continuously rotated through a circular path due to the jet action of their tangentially directed discharges. U.S. Pat. Nos. 1,948,167 and 3,067,739 disclose hydrotherapy apparatuses having rotating water wheels driven by pressurized water which is discharged through fixed, non-rotating nozzles.

U.S. Pat. No. 1,038,656 discloses a hydrotherapy apparatus having a rubber massage member which is rotated by a water wheel driven by pressurized water. Water which serves to rotate the water wheel may thereafter pass through a plurality of passages or nozzles in the rotating message member. A pair of overlapping perforated disks can be adjustably rotated to vary the amount of water delivered through the nozzles in the rotating massage member.

Finally, U.S. Pat. No. 2,304,616 discloses a hydrotherapy apparatus having a water wheel which is rotated by pressurized water. A massaging element may be affixed to the water wheel for accomplishing rotating massaging action. The face of the water wheel and the face of the massaging element are provided with registering suction openings which assist in producing a whirling action of the water when the appratus is submerged. After the pressurized water flows past the water wheel it is discharged through the space between the casing of the apparatus and the perimeter of the water wheel. An air supply duct communicates with the water supply duct to the water wheel for aeration of the water as it rotates the water wheel.

SUMMARY OF THE INVENTION

Among the objects and advantages of the present invention are to provide:

- an improved hydrotherapy apparatus adapted to discharge a submerged helical stream of aerated pressurized water into a bath, thus providing increased agitation of the bath water and a more invigorating massage;
- a hydrotherapy apparatus having a single nozzle which is continuously rotated through a circular path, thereby simulating the effect of multiple stationary nozzles positioned at different submerged locations within the bath;
- a hydrotherapy apparatus having a single nozzle of double-elbow configuration, the outlet of which is continuously rotated through a circular path by a water wheel driven by a source of pressurized water which is discharged through the nozzle after flowing past the water wheel;
- a hydrotherapy apparatus having a nozzle which is rotated through a circular path by a water wheel which is designed to translate the energy of the pressurized water into rotational energy in a highly efficient manner;
- a hydrotherapy apparatus having a nozzle which is rotated through a circular path by a water wheel, which apparatus can be rapidly disassembled for maintenance and/or repair;
- a hydrotherapy apparatus having a nozzle which is rotated through a circular path by a water wheel, in which a single source of pressurized water drives the water wheel and is discharged through the nozzle, the apparatus including valve means for varying the speed of rotation of the nozzle and the pressure of the water discharged from the nozzle.

The present invention provides a hydrotherapy apparatus which includes a single tubular nozzle, which is rotated through a circular path by a water wheel mounted within an impeller housing. Means are provided for mounting the water wheel within the housing so that it can be rotated by pressurized water, at a predetermined minimum pressure level, flowing through the housing from an inlet opening to an outlet openings. The nozzle has an inlet extending axially through the center of the water wheel and an outlet radially spaced from the center of the water wheel. Means are provided for rigidly securing the nozzle inlet to the water wheel so that rotation of the water wheel will rotate the nozzle outlet through a circular path. Finally, conduit means are provided for supplying water, at a pressure equal to or greater than the predetermined minimum level, to the inlet opening of the housing. Conduit means are also provided for supplying water from the outlet opening of the housing to the nozzle inlet so that the water will be discharged from the nozzle outlet as it rotates.

BRIEF DESCRIPTION OF THE DRAWINGS

Other objects and advantages of the present invention will be apparent from the following detailed description of a preferred embodiment thereof and from the attached drawing, of which.

DESCRIPTION OF THE PREFERRED EMBODIMENT

Figure 1:
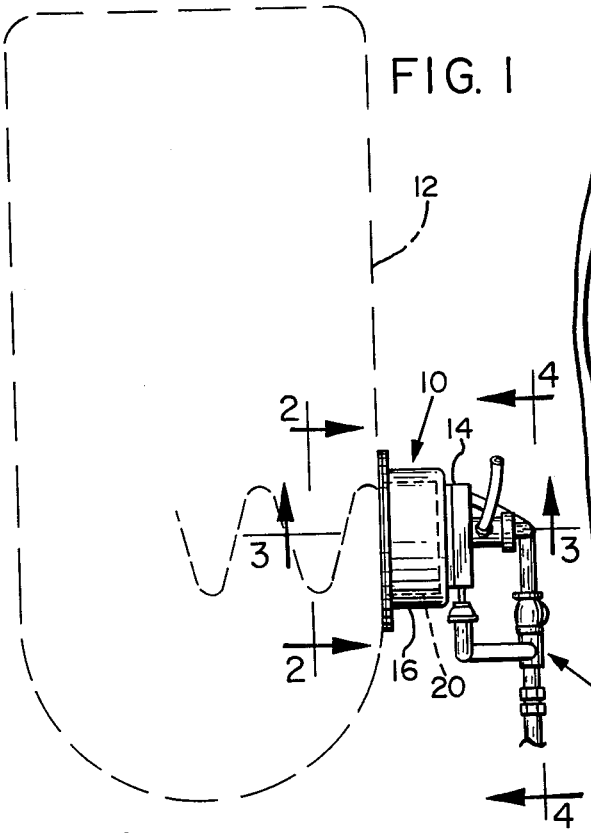
FIG. 1 is a plan view of the preferred embodiment of the hydrotherapy apparatus mounted on the side of a bathtub shown in phantom lines.

Referring to FIG. 1, the illustrated embodiment of the hydrotherapy apparatus 10 of the present invention may be mounted on the side wall of a tub 12 below the typical water level in the tube when it is in use. A water wheel (not visible in FIG. 1) is rotatably mounted inside an impeller housing 14 secured at the rearward end of a watertight mounting enclosure 16, the forward end of which is bolted to the wall of the tub 12 over a large circular hole cut therethrough. A single nozzle 18 (FIG. 3) having a double-elbow configuration is encased within a cylindrical flywheel structure 20 (shown in phantom lines in FIG. 1). These are rotated by the water wheel inside the enclosure 16 which is filled with water when the tub is full. Conduits generally designated 22 divide a source of pressurized water, typically at a standard household pressure of 60 PSI, so that a first portion of the water drives the water wheel before rejoining the second portion. Both portions of the water ultimately flow through the center of the rotating water wheel and the rotating nozzle and are discharged in a helical stream in the tub water.

The water wheel 24 (FIG. 4) is rotatably mounted within the impeller housing 14. The nozzle 18 (FIG. 3) has an inlet segment 26 which extends axially thorugh the center of the water wheel, an intermediate segment 28 which extends radially from the inlet segment 26, and an outlet segment 30 which extends axially away from the water wheel 24. A ball and socket type nozzle outlet (not shown in the drawings) is preferably connected to the discharge end of the outlet segment 30 of the nozzle 18. In this manner, the angle of discharge can be manually adjusted. The cylindrical flywheel structure 20 encases the intermediate and outlet segments of 28 and 30 of the nozzle so that its axis of rotation is in alignment with the axis of rotation of the water wheel. The flywheel structure 20 has two basic functions. First of all it streamlines the rotating nozzle. When encased in this manner, the nozzle has a significantly lower fluid resistance during rotation than it would have if it were not encased. Secondly, the flywheel structure 20 stores rotational momentum so that the nozzle will rotate more uniformly and will more readily overcome any brief impediment to its rotation.

Figure 2:
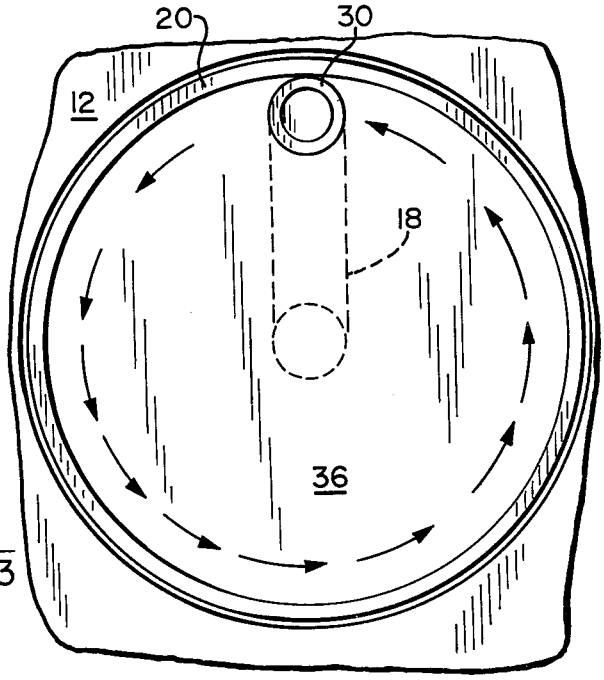
FIG. 2 is an enlarged elevational view of the hydrotherapy apparatus taken along line 2—2 of FIG. 1, showing details of the cylindrical flywheel structure which encases the nozzle of the hydrotherapy apparatus.

The flywheel structure 20 includes an annular wall 32. It also has a circular back disk 34 with a central hole therethrough for tightly receiving the inlet segment 26 of the nozzle. The disk 34 is secured within the wall 32 adjacent the rearward edges thereof. A face disk 36 (FIGS. 2 and 3) has a hole therethrough adjacent its periphery for tightly receiving the outlet segment 30 of the nozzle. The disk 36 tightly fits within the forward portion of the annular wall 32, and is preferably recessed somewhat from the forward edge 38 (FIG. 3) thereof. The face disk 36 is positioned against stops such as 40 which are glued or otherwise secured to the inner surface of the annular wall 32. The outlet segment 30 of the nozzle which discharges a stream of pressurized water in the direction indicated by the arrow in FIG. 3, preferably terminates short of the forward edge 38 of the annular wall 32. The likelihood of the outlet segment 30 striking the body of the bather during rotation is substantially reduced in this manner.

Figure 3:
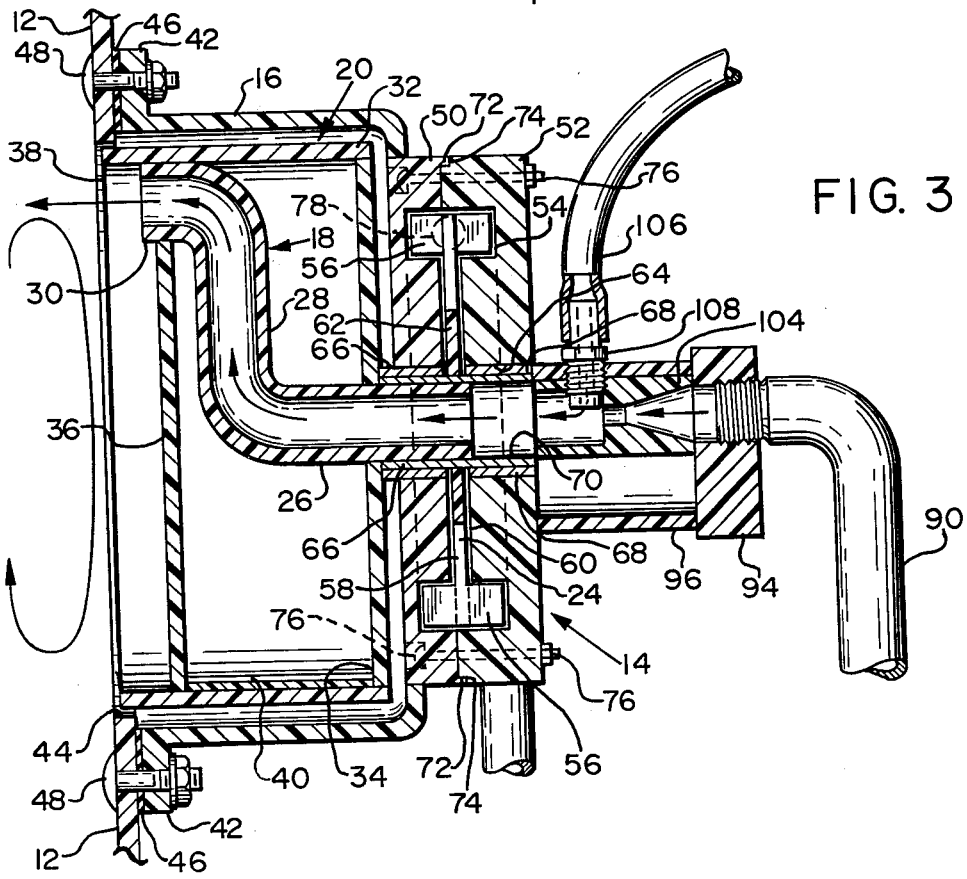
FIG. 3 is an enlarged vertical sectional view of the hydrotherapy apparatus taken along line 3—3 of FIG. 1.
Figure 4:
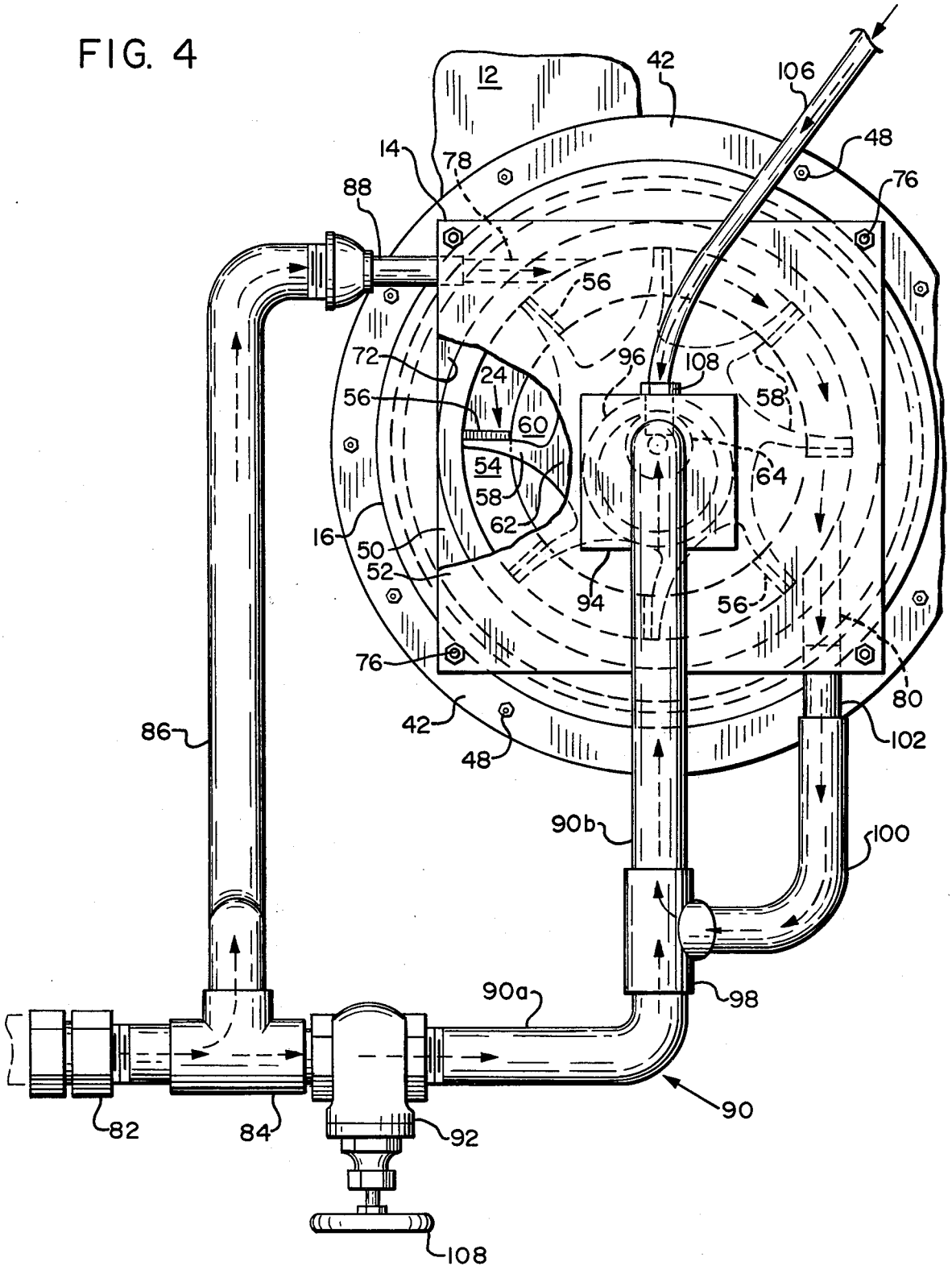
FIG. 4 is an enlarged elevational view of the hydrotherapy apparatus taken along line 4—4 of FIG. 1, and showing details of its impeller housing and water wheel in phantom lines.

The impeller housing 14 is secured to and forms the rearward wall of the watertight mounting enclosure 16 (FIG. 3). The enclosure preferably has a cylindrical configuration and is provided at its forward end with an annular flange 42 to facilitate mounting of the enclosure over a large circular hole 44 in the wall of the tub 12. Preferably an elastomeric gasket 46 is positioned between the wall of the tub 12 and the flange 42 of the enclosure 16 which are tightly held together by a plurality of circumferentially spaced bolt and nut assemblies 48 (FIGS. 3 and 4).

The impeller housing 14 (FIG. 3) is made of two blocks, 50 and 52 (FIG. 3), having mating faces which are conformably shaped or grooved to define an annular channel 54 (FIGS. 3 and 4) therebetween when joined. The annular channel 54 has a rectangular cross section. The water wheel 24 has a plurality of rectangular paddles 56 (FIGS. 3 and 4) which travel within the annular channel 54 during rotation of the water wheel. The paddles 56 have a rectangular cross section corresponding in shape to, and slightly smaller than, the cross section of the annular channel 54. The paddles 56 are secured to the ends of a plurality of relatively thin radially extending arms 58 (FIGS. 3 and 4). These arms travel within a relatively thin disk-like channel 60, also formed by the mating faces of the blocks 50 and 52. The arms 58 of the water wheel are integrally formed with and extend radially from a central disk portion 62 (FIG. 4).

A relatively large bore 64 (FIG. 3) extends through the blocks 50 and 52 of the impeller housing 14 so that it is centrally positioned with respect to and communicates with the annular and disk-like channels 54 and 60. A pair of bearing sleeves 66 and 68 are tightly fit into opposite ends of the bore 64 through the impeller housing 14. The opposing end edges of the sleeves 66 and 68 coincide with opposite sides of the disklike channel 60.

The axle of the water wheel 24 comprises a short tubular member 70 (FIG. 3) which fits tightly in a central hole through the central portion 62 of the water wheel so that the member 70 extends an equal distance on each side thereof. The tubular axle 70 fits within the bores of the sleeves 66 and 68. The axle 70 has an outside diameter which is slightly smaller than the inside diameter of the sleeves 60 and 68. During operation of the hydrotherapy apparatus a small amount of water from within the impeller housing 14 and from within the mounting enclosure 16 flows in between the tubular axle 70 and the bearing sleeves 66 and 68. This forms a water lubricated bearing which reduces the friction encountered by the water wheel during rotation. The inlet segment 26 of the nozzle is rigidly secured within the bore of the axle member 70. Preferably the segment 26 can be tightly inserted into and withdrawn from the axle member 70. This allows the nozzle and flywheel structure to be quickly repaired or replaced.

The mating faces of the blocks 50 and 52 of the impeller housing are further formed with a mating lip 72 and recess 74 (FIG. 3), respectively, around their outer peripheries. When the mating faces of the blocks are joined the mating lip and recess insure that the half sections of the annular channel 54 are in alignment. The impeller housing 14 is preferably made so that it can quickly be disassembled for maintenance and/or repair. Means are provided for releasably securing the blocks 50 and 52 together about the water wheel 24. One suitable means for this purpose comprises a plurality of bolt and nut assemblies 76 which extend through the blocks to tightly secure the same together.

Before the blocks 50 and 52 are joined, a coating of non-water soluble sealant material such as AQUA-LUBE (trademark) grease is applied to the abutting or mating surfaces thereof to insure that the annular channel 54 is water-tight so that water does not leak from the impeller housing between the edges of the blocks. It is desirable that the blocks 50 and 52 be made of a transparent material such as PLEXIGLASS (trademark) plastic so that any damage to the water wheel or any obstruction within the channels 54 and 60 thereof can be observed without disassembling the housing.

The blocks of the impeller housing further have inlet and outlet openings 78 and 80 (FIG. 4). The inlet and outlet openings are positioned and sized so that pressurized water, at a predetermined minimum pressure level, flowing through the housing from its inlet opening to its outlet opening will move the paddles 56 within the annular channel 54, causing the water wheel to rotate the double-elbow nozzle 18. The inlet and outlet openings communicate tangentially with the annular channel 54 so that a majority of the pressurized water flowing in through the inlet opening travels about a 90 degree arc as indicated by the arrows before leaving the housing through the outlet opening.

It is preferable that the paddles 56 move within an annular channel as previously described rather than having paddles which extend radially through the center of the water wheel and which rotate in a large cylindrical chamber. The latter referred to construction is less efficient in terms of translating the energy of the incoming pressurized water into rotational energy. It may be desirable to replace the flat paddles 56 with cup shaped paddles to further increase the efficiency of the water wheel as is well known in the hydroelectric power field. The outlet opening of the impeller housing is preferably larger than the inlet opening thereof, to reduce back pressure when pressurized water flows through the housing and thus further increase the efficiency of the water wheel.

The hydrotherapy apparatus of the present invention is further provided with conduit means for dividing a source of pressurized water into a first portion which rotates the water wheel before rejoining a second portion. Both portions ultimately flow axially through the center of the water wheel and are discharged from the rotating outlet segment of the double-elbow nozzle. The conduit means further includes a venturi for aerating the water before it flows into the nozzle.

Referring to FIG. 4, a main supply conduit 82 is connected at its one end to a source of water at, for example, a standard household pressure of 60 PSI. The other end of the main supply conduit is connected to a T-shaped connector 84. A first subconduit 86 is connected to the T-shaped connector 84 at its one end and at its other end to a pipe fitting 88 inserted in the inlet opening 78 of the impeller housing 14. A second subconduit 90 is connected at its one end to the T-shaped connector 84 through a valve means 92 later described. The other end of the second subconduit 90 is screwed into a hole through a connector block 94 (FIG. 3) secured over one end of a hollow cylindrical mounting 96. The other end of the mounting 96 is secured to the back face of the block 52, over the bore 64 therethrough.

Referring again to FIG. 4, the second subconduit 90 has two segments, **90*a* and 90*b*, which are joined by a second T-shaped connector 98. A third subconduit 100 connects a second pipe fitting 102 which is secured in the outlet opening 80 of the housing 14 with the second T-shaped connector 98. It can thus be seen that pressurized water from the main supply conduit 82 is divided by the first T-shaped connector 84. A first portion of this water flows through the first subconduit 86 through the annular channel 54 of the impeller housing 14 to rotate the water wheel 24 and the double-elbow nozzle 18. After rotating the water wheel, this first portion of the water flows out of the impeller housing through the third subconduit back into the second subconduit. Here the first portion of the water joins the second portion of the water. Next, the rejoined first and second portions flow through the segment 90*b*** of the second subconduit, thorugh the center of the water wheel and through the double-elbow nozzle.

A venturi 104 (FIG. 3) is positioned within the cylindrical mounting 96 so that water from the second subconduit flows therethrough before entering the nozzle. An air tube 106 has an upper end which extends above the surface of the water in the tub and a lower end which is fit over a connector 108 extending through the mounting 96 and into the venturi 104 at the proper position. During operation of the hydrotherapy apparatus air is sucked through the tube 106 by the venturi 104 for aerating the water before it is discharged from the rotating nozzle. The invigorating effect of an aerated stream of pressurized water in a tub or pool is well recognized.

The conduit means of the hydrotherapy apparatus further includes valve means 92 for dividing pressurized water from the source between the first and second subconduits in varying amounts. One suitable valve means comprises a standard plumbing gate valve having a manually rotatable knob 108. The knob can be adjusted to vary the size of the valve flow-through aperture between completely open and completely closed conditions. The valve permits the pressure and amount of water utilized to rotate the water wheel to be reduced to keep the rotational speed of the nozzle relatively slow without lowering the pressure of the water discharge from the nozzle. Such a condition is achieved by opening the valve 92 substantially. The water encounters significantly greater resistance in flowing through the first and third subconduits and the impeller housing than in flowing through the second conduit directly into the nozzle. Therefore, when the valve 92 is substantially open a majority of the water will flow directly through the nozzle. During normal operation, for example, approximately thirty-five percent of the water is used to rotate the water wheel.

The valve 92 can be progressively closed to increase the speed of rotation of the nozzle. Complete closing of the valve 92 will cause the nozzle to rotate at its highest speed. In this condition the pressure of the water discharged from the nozzle will in theory be reduced the greatest amount since the greatest amount of the potential energy in the pressurized water has been used to rotate (at their highest speeds) the water wheel, nozzle, and cylindrical fly wheel structures.

Having described a preferred embodiment of the hydrothereapy apparatus it will be apparent to those skilled in the art that the invention permits of modification in both arrangement and detail. For example, it may be desirable to connect the main conduit of the venturi directly to the outlet of the impeller housing so that the venturi will facilitate rotation of the water wheel. A second valve may be used to connect the second subconduit with the venturi to permit greater flexibility in controlling the speed of rotation of the nozzle and the pressure of the discharge. The water wheel may be connected to a worm gear drive to obtain a drive shaft for rotating the nozzle with greater torque. The apparatus may be made of a wide variety of materials, however, plastic is preferred because it is inexpensive and not subject to rust. However, the plastic should be resistant to temperatures as high as 212° F. since heated water may be passed therethrough. The double-elbow configuration of the nozzle can be altered in any fashion as long as the discharge end of the nozzle is spaced in a radial direction a sufficient distance from the axis of rotation of the water wheel so that the stream of water assumes a helical configuration that will give the desired invigorating effect. For example, the intermediate and outlet segments could be eliminated and the cylindrical fly wheel structure would in effect function as the nozzle with the water being discharged from the hole through the face disk adjacent its periphery. However, the present invention is to be limited only in accordance with the true spirit and scope of the following claims.

We claim:

1. A hydrotherapy apparatus comprising:

an impeller housing having inlet and outlet openings;

a water wheel and means for mounting the water wheel within the housing so that it can be rotated by pressurized water, at a predetermined minimum pressure level, flowing through the housing from its inlet opening to its outlet opening;

a single tubular nozzle having an inlet extending axially through the center of the water wheel and an outlet radially spaced from the center of the water wheel;

means for rigidly securing the nozzle inlet to the water wheel so that rotation of the water wheel will rotate the nozzle outlet through a circular path; and conduit means for supplying water, at a pressure equal to or greater than the predetermined minimum level, to the inlet opening of the housing and then from the outlet opening of the housing to the nozzle inlet so that the water will be discharged from the nozzle outlet as it rotates.

2. The apparatus of claim 1 wherein the conduit means includes a venturi for aerating the water after it flows through the impeller housing and before it flows through the nozzle.

3. The apparatus of claim 1 and further comprising a cylindrical flywheel structure for encasing the nozzle so that it can be more easily rotated when submerged.

4. The apparatus of claim 1 wherein the conduit means includes a main supply conduit adapted to be connected at its one end to a source of pressurized water, a first subconduit connecting the other end of the main conduit with the inlet opening of the housing, a second subconduit for also connecting the other end of the main conduit to the nozzle inlet, a third subconduit connecting the outlet opening of the housing with the second subconduit, and adjustable valve means for dividing the pressurized water from the source between the first and second subconduits in varying amounts.

5. The apparatus of claim 1 wherein the housing defines an annular channel and the inlet and outlet openings communicate tangentially with the channel, and further wherein the water wheel has a plurality of paddles which travel within the channel.

6. The apparatus of claim 1 wherein the outlet opening of the housing is larger than the inlet opening of the housing to reduce back pressure when pressurized water flows through the housing from its inlet opening to its outlet opening.

7. The apparatus of claim 1 wherein the water wheel mounting means includes a water lubricated bearing.

8. The apparatus of claim 1 wherein the housing is made of two blocks of material having mating faces which are conformably shaped to define an annular channel therebetween when joined, and means for releasably securing the blocks together when so joined.

9. The apparatus of claim 8 wherein the mating faces of the blocks have a mating lip and recess for ensuring proper alignment so that when joined the blocks form the annular channel.

10. The apparatus of claim 8 wherein a non-water soluble sealant material is applied to the mating faces of the blocks before they are so joined to ensure a water tight channel.

11. A hydrotherapy apparatus comprising:

an impeller housing having inlet and outlet openings, the housing made of two blocks having mating faces which are conformably shaped to define an annular channel therebetween when joined, the inlet and outlet openings communicating tangentially with the channel, the outlet opening being larger than the inlet opening, the mating faces of the blocks further having a mating lip and recess for ensuring proper alignment so that when joined the blocks form the channel, and means for releasably securing the blocks together when so joined;

a water wheel and means for mounting the water wheel within the housing so that it can be rotated by pressurized water, at a predetermined minimum pressure level, flowing through the housing from its inlet opening to its outlet opening, the water wheel having a plurality of paddles which travel within the channel, and the water wheel mounting means including a water lubricated bearing;

a single tubular nozzle having an inlet segment extending axially through the center of the water wheel, an intermediate segment extending radially from the inlet segment, and an outlet segment extending axially away from the waterwheel;

means for rigidly securing the inlet segment to the water wheel so that rotation of the water wheel will rotate the outlet segment through a circular path;

a cylindrical flywheel structure for encasing the intermediate and outlet segments of the nozzle so that the axis of rotation of the flywheel structure is aligned with the axis of rotation of the water wheel; and conduit means for supplying water to the inlet opening of the housing and then from the outlet opening of the housing to the inlet segment of the nozzle so that the water will be discharged from the outlet segment of the nozzle as it rotates, the conduit means including, a main supply conduit adapted to be connected at its one end to a source of water at a pressure greater than the predetermined minimum level, a first subconduit connecting the other end of the main conduit with the inlet opening of the housing, a second subconduit for also connecting the other end of the main conduit to the inlet segment of the nozzle, a third subconduit connecting the outlet opening of the housing with the second subconduit, a venturi for aerating the water in the second subconduit before it flows through the nozzle, and adjustable valve means for dividing the pressurized water from the source between the first and second subconduits in varying amounts.

* * * * *